United States Patent [19]

Brissette

[11] Patent Number: 4,716,948

[45] Date of Patent: Jan. 5, 1988

[54] PARI-MUTUEL BETTOR'S ORGANIZING WALLET

[76] Inventor: Ronald A. Brissette, 6048 Kenwood La., Apt. B, Fort Myers, Fla. 33907

[21] Appl. No.: 884,054

[22] Filed: Jul. 10, 1986

[51] Int. Cl.[4] ..... A45C 1/06; A45C 11/18

[52] U.S. Cl. ..... 150/132; 150/141; 150/143; 150/147; 206/39; 206/39.1; 206/39.3; 206/214

[58] Field of Search ..... 150/131, 132, 135, 140, 150/141, 145, 147-149, 143, 106; 40/10 R, 10 D, 159; 206/37, 38, 39, 39.3, 214, 215, 450, 579

[56] References Cited

U.S. PATENT DOCUMENTS

| | | | |
|---|---|---|---|
| Re. 17,465 | 10/1929 | Osborn | 206/215 |
| 258,196 | 5/1882 | Cross | 40/10 R |
| 479,655 | 7/1892 | Morton | 150/143 |
| 730,096 | 6/1903 | Cook | 150/135 X |
| 781,948 | 2/1905 | Hegele | 150/131 X |
| 1,476,697 | 12/1923 | Dwyer | 206/214 |
| 1,765,730 | 6/1930 | L'Enfant | 150/140 |
| 1,859,631 | 5/1932 | Osborn | 206/215 |
| 2,275,363 | 3/1942 | Guhne | 150/131 |
| 2,520,176 | 8/1950 | Stanley | 150/145 X |
| 2,581,029 | 1/1952 | Knee | 150/141 X |
| 2,647,071 | 7/1953 | Schade | 150/132 X |
| 2,710,037 | 6/1955 | Caldwell | 150/143 X |
| 3,267,980 | 8/1966 | Bird | 150/145 X |
| 3,360,027 | 12/1967 | Price | 150/132 |
| 3,759,305 | 9/1973 | McIntyre | 150/149 |
| 4,420,112 | 12/1983 | Cline | 150/135 X |

*Primary Examiner*—William Price
*Assistant Examiner*—Sue A. Weaver
*Attorney, Agent, or Firm*—Merrill N. Johnson

[57] ABSTRACT

A wallet sized to fit folded into the breastpocket of a jacket for use by pari-mutuel bettors to organize their cash and notes and pari-mutuel tickets. The wallet contains two identical pockets for separating betting cash from winning cash, three identical slots for storing purchased pari-mutuel tickets arranged one above the other by events, a fourth slot spaced from the other three slots for storing winning tickets, a slot for a pad of notepaper, and a sleeve for holding a pen or pencil.

5 Claims, 3 Drawing Figures

PARI-MUTUEL BETTOR'S ORGANIZING WALLET

BACKGROUND AND SUMMARY OF THE INVENTION

The invention relates to a wallet for use by pari-mutuel betters to keep track of their folding money, written notes and pari-mutuel tickets during the events on which they are betting.

Pari-mutuel betting machines are widely used at horse race-tracks, dog tracks and jai alai stadiums. The machines dispense to persons making bets uniformly sized pari-mutuel tickets approximately two inches by four inches. During the course of the races or games, a serious bettor may accumulate a dozen or more pari-mutuel tickets and, when the events are finished, the bettor needs to present his winning tickets to be turned into cash.

In addition to the money needed to purchase pari-mutuel tickets and the pari-mutuel tickets themselves, many serious bettors also carry a pen or pencil and a notepad containing information about the race transcribed prior to coming to the track or stadium and also to make computations and notes relating to the races or game being played.

Since the usual apparel worn by both male and female pari-mutuel bettors does not contain pockets suitable for orderly segregation of their cash and pari-mutuel tickets, I have invented a unique pari-mutuel bettor's organizer which separates winning cash from betting cash, stores purchased pari-mutuel tickets in separate slots for the event to which the ticket pertains, segregates winning tickets in an easily accessible slot, and also provides space for a notebook and a pen or pencil.

A number of types of pocketbooks, cases and wallets have been suggested for carrying paper money and business cards, tickets, calendars, memo pads and the like. However, the only patent of which I am aware that is specifically directed to a ticket and money holder for use at dog tracks is Price U.S. Pat. No. 3,360,027 whose features are quite different from my organizing wallet.

My bettor's organizing wallet preferably is made with an outside layer of opaque soft leather-like plastic and an interior layer of transparent flexible plastic. The wallet is preferably of a size that when it is folded along its center, the wallet will fit into the breastpocket of a jacket or suit coat to be carried out of sight but still easily accessible to the bettor.

The wallet contains two identical pockets, one on each side of its centerfold. The pockets open along the wallet's edge parallel with its centerfold for holding paper money. These pockets can be securely closed by a snap or by two cooperating strips of velcro sewn along the insides of the open edges of each cash-holding pocket.

The wallet also contains a vertical row of preferably three slots appropriately labeled and sized to receive pari-mutuel tickets depending upon the number of the event to which the tickets pertains. This row of slots positioned one above the other lies on one side of the centerfold. The slots being in the clear plastic layer permit ready identification of tickets partially inserted into one of the slots.

On the opposite side of the interior of the wallet is a fourth slot labeled "winning tickets" sized to receive winning pari-mutuel tickets. Also on this side of the wallet is a slot designed to receive a pad of notepaper and a sleeve which is designed to receive either a pen or a pencil.

My wallet with the foregoing features will permit the serious bettor to transcribe useful betting information onto the pad prior to arriving at the track or stadium and also to securely carry all the folding money he intends to bet in the "betting cash" pocket of the wallet. Then as he purchases pari-mutuel tickets, they can be stored in an orderly way in the three "events" slots of the wallet and, as some of them become winning tickets, these tickets can be transferred to the "winning tickets" slot on the opposite side of the wallet. And, of course, as winning tickets are exchanged for cash, this paper money can be placed in the "winning cash" pocket of the wallet.

DETAILED DESCRIPTION OF THE PREFERRED EMBODIMENT

Figure 1:
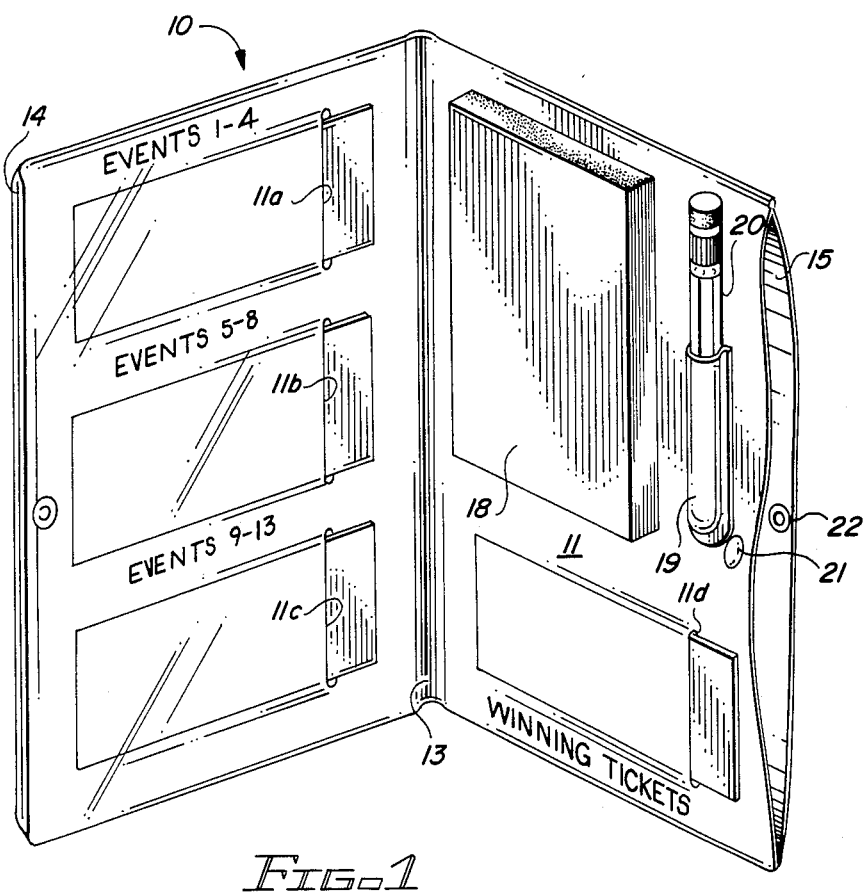
FIG. 1 is a perspective view of my bettor's wallet in an unfolded or open position with pari-mutuel tickets in each of the wallet's four slots and a pad of notepaper and an pencil carried by the wallet.
Figure 2:
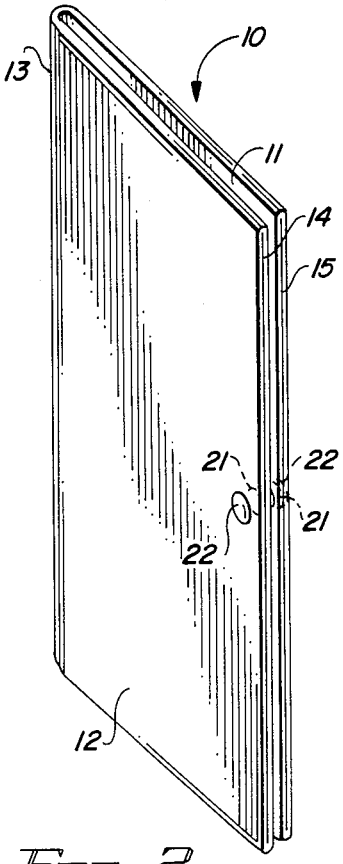
FIG. 2 is a perspective view of my wallet in its folded or closed position.

Referring first to FIG. 1 of the drawing, a preferred embodiment of my wallet 10 is shown in open position. Inner layer 11 of wallet 10 is made of a clear flexible plastic material which contains four slots 11*a*, 11*b*, 11*c* and 11*d* sized to receive standard 2-inch by 4-inch pari-mutuel tickets as shown.

Outer layer 12 of wallet 10 is made of an opaque pliable plastic material approximately 9 inches square. Inner layer 11 and outer layer 12 are joined together along their upper and lower edges and along their centerfold 13, thereby making between them two identical pockets 14 and 15 amply sized to receive a generous quantity of U.S. paper currency. In order to prevent interference between the pari-mutuel tickets inserted into slots 11*a*, 11*b*, 11*c* and 11*d* and the paper currency placed in pockets 14 and 15, a thin relatively rigid sheet of opaque plastic material is placed inside each of pockets 14 and 15. These two sheets 16 and 17 are shown in FIG. 3.

Figure 3:
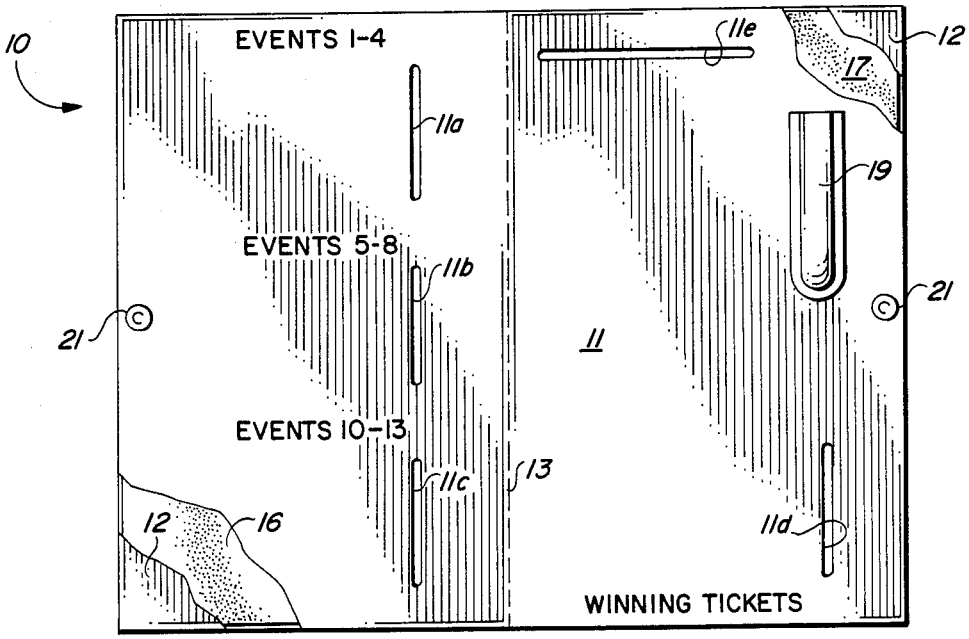
FIG. 3 is a front plan view of the wallet in an open position with the inside layer partially broken away to show the construction of the money-carrying pockets.

Inner layer 11 also includes an additional slot 11*e* shown in FIG. 3 designed to receive the back of a pad of notepaper 18 as shown in FIG. 1. Also attached to inner layer 11 is a sleeve 19 of pliable plastic material designed to receive and hold a pen or pencil 20 as shown in FIG. 1.

Each of the money-holding pockets 14 and 15 is closed by two cooperating parts 21 and 22 of a snap or by other closure means attached respectively to the edges of outer layer 12, sheets 16 and 17 and inner layer 11 as best shown in FIG. 1.

While I have shown and described a preferred embodiment of my pari-mutuel bettor's organizer, various modifications and changes and rearrangements will be apparent to those who are skilled in the art. Such modifications may be made without departing from the spirit of my invention, whose scope is limited only by the appended claims.

I claim:

1. A pari-mutuel bettor's wallet comprising an outer layer of opaque flexible material and an inner layer of transparent flexible material joined together along two of their opposite edges and also joined together along the centerline of their two joined edges to form two identical pockets each sized to contain a quantity of unfolded U.S. paper currency, the inner layer of transparent flexible material on one side of its joined centerline containing three identical slots arranged one above the other each sized to receive several two by four inch pari-mutuel tickets, and said inner layer on the opposite side of its joined centerline containing a fourth slot sized to receive pari-mutuel tickets, a fifth slot sized to receive the back of a pad of note paper, and a sleeve for holding a pen or pencil.

2. A bettor's wallet as set forth in claim 1 in which each pocket includes means for closing the opening in the pocket.

3. A bettor's wallet as set forth in claim 1 in which the opening in each of the wallet's two pockets is closed by a snap.

4. A pari-mutuel bettor's wallet comprising an outer layer of opaque flexible plastic material and an inner layer of transparent flexible plastic material joined together along two of their opposite edges and also joined together along the centerline of their two joined edges to form two identical pockets each sized to contain a quantity of unfolded U.S. paper currency, the inner layer of transparent flexible material on one side of its joined centerline containing three identical slots arranged one above the other each sized to receive several two by four inch pari-mutuel tickets, said inner layer on the opposite side of its joined centerline containing a fourth slot sized to receive several pari-mutuel tickets, a fifth slot sized to receive the back of a pad of note paper, and a sleeve for holding a pen or pencil, and a thin sheet of rigid material sized to fit snugly into each of the two pockets of the wallet.

5. A bettor's wallet as set forth in claim 4 in which each of the wallet's two pockets can be closed by a snap.

* * * * *